United States Patent [19]

Goffe

[11] 4,230,782

[45] Oct. 28, 1980

[54] MIGRATION IMAGING SYSTEM WITH MENISCUS DEVELOPMENT

[75] Inventor: William L. Goffe, Webster, N.Y.

[73] Assignee: Xerox Corporation, Stamford, Conn.

[21] Appl. No.: 905,906

[22] Filed: May 15, 1978

Related U.S. Application Data

[60] Continuation of Ser. No. 300,940, Oct. 26, 1972, abandoned, which is a division of Ser. No. 84,691, Oct. 28, 1970, abandoned, which is a continuation-in-part of Ser. No. 837,780, Jun. 30, 1969, Pat. No. 3,975,195, and Ser. No. 483,675, Aug. 30, 1965, abandoned, said Ser. No. 837,780, is a continuation-in-part of Ser. No. 483,675, Aug. 30, 1965, and Ser. No. 725,676, May 1, 1968, abandoned, and Ser. No. 460,377, Jun. 1, 1965, Pat. No. 3,520,681, and Ser. No. 403,002, Oct. 12, 1964, abandoned, said Ser. No. 483,675, and Ser. No. 460,377, is a continuation-in-part of Ser. No. 403,002, , abandoned.

[51] Int. Cl.[2] ..... G03G 17/00; G03G 13/22

[52] U.S. Cl. ..... 430/41; 355/10; 118/661; 118/662; 430/117

[58] Field of Search ..... 96/1 PS, 1 LY; 355/10; 118/661, 662; 427/15, 16

[56] References Cited

U.S. PATENT DOCUMENTS

| | | | |
|---|---|---|---|
| 2,877,133 | 3/1959 | Mayer | 96/1 LY X |
| 3,169,887 | 2/1965 | York | 118/661 X |
| 3,203,395 | 8/1965 | Liller | 118/661 X |
| 3,367,791 | 2/1968 | Lein | 118/661 X |
| 3,368,526 | 2/1968 | Matsumoto et al. | 427/15 X |
| 3,369,918 | 2/1968 | Young | 427/15 X |
| 3,413,143 | 11/1968 | Cameron et al. | 118/661 X |
| 3,416,493 | 12/1968 | Robinson et al. | 427/15 X |
| 3,542,465 | 11/1970 | Pundsack et al. | 96/1 PS |
| 3,677,750 | 7/1972 | Mammino et al. | 96/1 PS |
| 3,741,760 | 6/1973 | Snelling | 96/1 R |

*Primary Examiner*—Roland E. Martin, Jr.

[57] ABSTRACT

A migration imaging system wherein an imaging member comprising migration marking material contained in or contacting a softenable layer on a supporting substrate has a latent image formed thereon, and the latently imaged member is developed by passing it through one or more small meniscuses bonding at least in part a volume of liquid which is capable of changing the resistance of the softenable material, to migration of the migration marking material toward the substrate. Alternately, an imaged migration type imaging member, having marking material in a migrated image configuration and in a background configuration which is at least in part spaced apart in depth in the softenable layer from said image configuration, is further developed by the inventive system.

40 Claims, 21 Drawing Figures

MIGRATION IMAGING SYSTEM WITH MENISCUS DEVELOPMENT

This is a continuation of application Ser. No. 300,940, filed Oct. 26, 1972, now abandoned; which is a divisional application of copending U.S. patent application Ser. No. 84,691, filed Oct. 28, 1970, abandoned, which is a continuation-in-part of my copending U.S. patent applications (1) Ser. No. 837,780, filed June 30, 1969, U.S. Pat. No. 3,475,195, and (2) Ser. No. 483,675, filed Aug. 30, 1965, abandoned; application (1) being a continuation-in-part of (2) and applications Ser. No. 725,676, filed May 1, 1968; Ser. No. 460,377, filed June 1, 1965, now U.S. Pat. No. 3,520,681; and Ser. No. 403,002, filed Oct. 12, 1964 (403,002 pending when 725,676 was filed, and 725,676 pending when application (1) was filed, but both 403,002 and 725,676, now abandoned; (2) and 460,377 both being continuation-in-part of 403,002.

BACKGROUND OF THE INVENTION

This invention relates in general to imaging, and more specifically to migration imaging wherein a migration marking material is selectively moved through a softenable medium and the development of migration imaging members to effect the selective movement of the migration marking material through such a softenable medium, or to enhance the quality of such migration-type images.

Recently, a migration imaging system capable of producing high quality images of high density, continuous tone, and high resolution has been developed. Such migration imaging systems are disclosed in copending applications Ser. No. 837,780, and Ser. No. 837,591, both filed June 30, 1969. In a typical embodiment of the new migration imaging system an imaging member comprising a substrate, a layer of softenable material and electrically photosensitive marking material is latently imaged by electrically charging the member and exposing the charged member to a pattern of activating electromagnetic radiation, such as light. Where the photosensitive migration marking material was originally in the form of a fracturable layer at the upper surface of the softenable layer, particles of the migration marking material in the exposed areas of the imaging member migrate toward the substrate when the member is developed by decreasing the resistance of the softenable layer to migration of the marking material toward said substrate.

"Softenable" as used herein is intended to mean any material which can be rendered more permeable thereby enabling particles to migrate through its bulk. Conventionally, changing the permeability of such material or reducing its resistance to migration of migration marking material is accomplished by dissolving, melting, and softening, by methods, for example, such as contacting with heat, vapors, partial solvents, solvent vapors, solvents and combinations thereof, or by otherwise reducing the viscosity of the softenable material.

"Fracturable" layer or material as used herein, means any layer or material which is capable of breaking up during development, thereby permitting portions of said layer to migrate toward the substrate or to be otherwise removed. The fracturable layer may be particulate, semi-continuous, microscopically discontinuous or continuous in various embodiments of the migration imaging members of the present invention. Such fracturable layers of marking material are typically contiguous the surface of the softenable layer spaced apart from the substrate, and such fracturable layers may be near, at, coated onto, or slightly, partially or substantially embedded in the softenable layer in the various embodiments of the imaging members of the inventive system. "Contiguous" for the purpose of this invention is defined as in Webster's *New Collegiate Dictionary,* Second Edition 1960: "In actual contact; touching; also, near, though not in contact; adjoining," and is intended to generically describe the relationship of the fracturable layer of marking material in the softenable layer, vis-a-vis the surface of the softenable layer spaced apart from the substrate.

There are various other systems for forming such images, wherein non-photosensitive or photosensitivity inert, marking materials are arranged in the aforementioned fracturable layers, or dispersed throughout the softenable layer in a binder configuration, as described in the aforementioned copending applications, which also disclose a variety of methods which may be used to form latent images upon such migration imaging members.

Various means for developing the latent images in the novel migration imaging system may be used. These development methods include solvent wash-away; solvent vapor softening, heat softening, and combinations of these methods, as well as any other method which changes the resistance of the softenable material to the migration of particulate marking material through said softenable layer to allow imagewise migration of the particles toward the substrate. In the solvent wash-away development method, the migration marking material migrates in imagewise configuration toward the substrate through the softenable layer as it is softened and dissolved, leaving an image of migrated particles corresponding to the desired image pattern on the substrate, with the material of the softenable layer substantially completely washed away. In the heat or vapor softening developing modes, the softenable layer is softened to allow imagewise migration of marking material toward the substrate and the developed image member generally comprises the substrate having migrated marking particles near the softenable layer-substrate interface, with the softenable layer and unmigrated marking materials intact on the substrate in substantially their original condition.

Various methods and materials and combinations thereof have previously been used to fix unfixed migration images. For example, fixing methods and materials are disclosed in copending applications Ser. No. 590,959, filed Oct. 31, 1966, and Ser. No. 695,214, filed Jan. 2, 1968.

In new and growing areas of technology such as the migration imaging systems of the present invention, new methods, apparatus, compositions of matter, and articles of manufacture continue to be discovered for the application of the new technology in new modes. The present invention relates to a new and advantageous system for the development of latent images or partially developed images in such migration imaging systems.

SUMMARY OF THE INVENTION

It is, therefore, an object of this invention to provide a novel migration imaging system.

It is another object of this invention to provide a novel imaging system wherein migration marking material is selectively displaced in image configuration in a layer of softenable material.

It is another object of this invention to provide a system for the development of latent images or partially developed images in migration imaging members.

It is another object of this invention to provide a system for the development of latent images in migration imaging members by the application of a liquid developer.

It is another object of this invention to provide a system for the development of latent images in migration imaging systems using a minimum and controlled amount of liquid developer which is metered onto and from the migration imaging member.

It is another object of this invention to provide a faster system for the development of latent images in migration imaging members while providing developed images of the same or higher quality than former developed migration images.

It is another object of this invention to provide a continuous system for the development of migration imaging members.

It is yet another object of this invention to provide a system for simultaneously developing and fixing migration images in migration imaging members.

It is still another object of this invention to provide a system for removing the outermost portions of layers of softenable material in migration imaging members.

The foregoing objects and others are accomplished in accordance with this invention by a system wherein a migration imaging member typically comprising migration marking material contained in or contacting a softenable layer on a supporting substrate has a latent image formed thereon, and is developed by passing the latently imaged member through one or more small meniscuses bounding at least in part a volume of developing liquid which is capable of changing the resistance of the softenable material to migration of the migration marking material toward the substrate.

BRIEF DESCRIPTION OF THE DRAWINGS

For a better understanding of the invention as well as other objects and further features thereof, reference is made to the following detailed disclosure of preferred embodiments of the invention taken in conjunction with the accompanying drawings thereof, wherein.

DESCRIPTION OF THE PREFERRED EMBODIMENTS

Figure 1A:
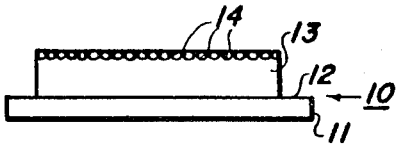
FIGS. 1*a*, 1*b*, 1*c*, and 1*d* are partially schematic, cross-sectional views of migration imaging members suitable for use in the inventive system.

In FIG. 1*a* a migration imaging member preferred for use in the advantageous system of the present invention is illustrated in partially schematic, cross-sectional view wherein the imaging member 10 comprises supporting substrate 11 supporting layer of softenable material 13 and a fracturable layer comprising migration marking material 14. Migration imaging members of this type may be referred to as the layered configuration migration imaging member, and such members are fully described in copending application Ser. No. 837,780 filed June 30, 1969, now U.S. Pat. No. 3,975,195, the entire disclosure of which is hereby incorporated by reference in the present specification.

Supporting substrate 11 may in various embodiments of such migration imaging members be either electrically conductive or electrically insulating, or even partially electrically conductive. The electrically insulating substrate materials will typically have resistivities of not less than about $10^{12}$ ohm-cm., and resistivities preferably not less than about $10^{14}$ ohm-cm. However, materials having lower resistivities will perform satisfactorily in various embodiments hereof. The supporting substrate 11 is preferably partially or substantially translucent or transparent where the imaging member is to be viewed with transmitted light. In some embodiments, substrate 11 may comprise a more electrically insulating material, and have a more electrically conductive material coated thereon at the surface 12, so that the coated substrate functions as an electrically conductive substrate.

The layer of softenable material 13 may comprise one or more layers of any suitable material which is softenable by any suitable means and is typically substantially electrically insulating for the preferred modes hereof of applying electrical migration forces to the migration layer: although, more conductive materials may be used because of the increased capability in the electrical mode hereof of applying a constant and replenishing supply of electrical charges in image configuration.

In still other embodiments, the softenable material may itself be electrically photosensitive or photoconductive; such softenable materials and imaging systems utilizing such materials are fully described in copending application Ser. No. 837,592, filed June 30, 1969, the entire disclosure of which is hereby incorporated by reference in the present specification. "Softenable" as used herein with reference to the material of layer 13 is intended to mean any material which can be rendered more permeable to the migration of particles of migration marking material through its bulk. Conventionally, changing the permeability of such material or reducing its resistance to the migration of such marking material particles, may be accomplished by dissolving, melting or softening, as by contact with heat, vapors, partial solvents, and combinations thereof, although any suitable means for migration developing the imaging member in the present invention is intended to be included herein.

Typical substantially electrically insulating softenable materials include a host of plastic or thermoplastic materials a large number of which are specifically recited in copending application Ser. No. 837,780; paraffins and waxes; and any other material which is typically substantially electrically insulating, and softenable by any suitable means when used in the advantageous system of the present invention. Such substantially insulating softenable materials will typically have resistivities not less than about $10^{10}$ ohm-cm., and preferably have resistivities of not less than about $10^{12}$ ohm-cm. However, in various embodiments of the inventive imaging system, softenable materials with even lower resistivities will perform satisfactorily.

Softenable layer 13 may be of any suitable thickness, with thicker layers generally requiring greater electrical potentials in the optimum and preferred modes of the present invention. Softenable layer thicknesses from about ½ to about 16 microns are found to be preferred, but uniform thickness over the imaging area in the range between about 1 and about 4 microns is found to provide high quality images while permitting ready image member construction.

The migration marking material 14 illustrated in a fracturable layer in FIG. 1*a*, may comprise any suitable material selected from an extremely broad group of materials and mixtures thereof including electrically conductive materials, insulating materials partially electrically conductive materials, electrically photosensitive materials, photosensitively inert materials, or any other material havng any other suitable physical characteristic. A host of such suitable materials are described in copending application Ser. No. 837,780. In FIG. 1*a* the migration marking material 14 is arranged in a fracturable layer contiguous the surface of the softenable layer spaced apart from the substrate, portions of which migrate towards or to the substrate during image formation under the influence of migration forces. It is preferred for images of highest resolution, density and utility that the fracturable layer of migration marking material 14 be a particulate material layer; however, such fracturable layers may also comprise any continuous or semi-continuous, or microscopically discontinuous fracturable layer, which is capable of breaking up into discrete particles of the size of an image element or less during the development step, thereby permitting portions of the fracturable layer to migrate toward the substrate in image configuration. As described in the incorporated disclosures, particles of the migration marking material suitable for use in the present invention are preferably of average size not greater than about 2 microns. Submicron particles give an even more satisfactory result, with an optimum range of particle size comprising particles of average size not greater than about 0.7 microns. When the migration marking material is arranged in a fracturable layer contiguous the surface of the softenable material spaced apart from the substrate, such fracturable layers are preferably of thicknesses in the range between about 0.01 to about 2.0 microns, although fracturable layers of thicknesses of about 5 microns have been found to give good results in various embodiments.

Migration marking materials used in the present invention will typically be substantially insoluble and otherwise not adversely reactive with either the softenable material or any other element in the imaging member, as well as any solvent liquid or vapor which may be used in the development step in the present invention.

Figure 1B:
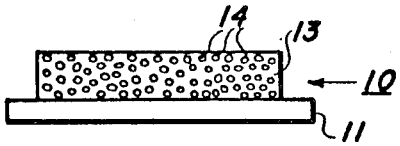

In FIG. 1*b*, the migration imaging member is illustrated in a binder-type configuration wherein the migration marking material 14 is dispersed throughout the layer of softenable material 13 which is supported by substrate 11. Such binder-type imaging members as well as materials and methods for their construction are fully described in copending application Ser. No. 837,591, filed June 30, 1969, the entire disclosure of which is hereby incorporated by reference in the present specification. Substrates 11, softenable materials 13, and migration marking materials 14, used in the binder-type imaging member are the same as or similar to those suitable for use in the layered configuration migration imaging member described above in conjunction with FIG. 1*a*.

Figure 1C:
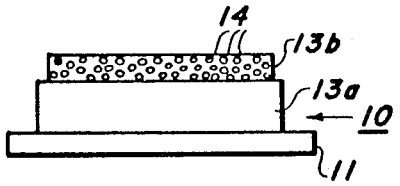

In FIG. 1*c*, another embodiment of the migration imaging member suitable for use in the present invention is ilustrated wherein the substrate 11 supports a first softenable layer 13*a*, which is typically substantially void or free of migration marking material, and a second softenable layer 13*b* overcoating the first softenable layer 13*a*, and the second softenable layer 13*b*, having migration marking material 14 dispersed throughout the softenable material. In this migration imaging member, two separate softenable layers facilitate the fabrication of the member in that first softenable layer may be applied to a suitable substrate and then the second softenable layer, containing the migration marking material 14 may be coated over the first softenable layer.

Figure 1D:
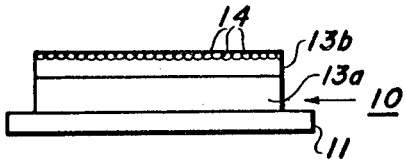
Figure 1E:
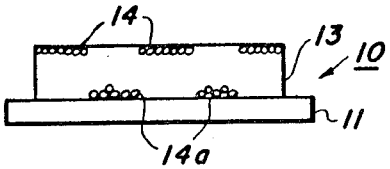

In FIG. 1*d*, still another embodiment of the migration imaging member suitable for use in the present invention is illustrated wherein a first softenable layer 13*a*, which is typically free or void of migration marking material is overcoated on substrate 11, and then a second softenable layer 13*b* having a fracturable layer of migration marking material 14 contiguous the surface of said second softenable layer opposite the surface thereof nearest the substrate 11, overcoats the first softenable layer. In such an embodiment, as well as in the embodiment illustrated in FIG. 1*c*, it is advantageous to use two different softenable materials in the softenable layers 13*a* and 13*b* wherein the softenable material used in the second softenable layer, 13*b*, exhibits greater solubility or greater speed of solubility in the liquid solvents, vapor solvents, or other media being used in the advantageous system of the present invention. Any suitable combination of the softenable materials suitable for use herein may be used in such embodiments. For example an imaging member having a first softenable layer comprising polystyrene of molecular weight of about 10,000, overcoated with a second softenable layer comprising polybutylmethacrylate, may be developed with petroleum ether, which differentially softens the two softenable layers. Similarly, an imaging member having a softenable layer comprising a custom-synthesized about 80/20 mole percent copolymer of styrene-hexlmethacrylate overcoated with a softenable layer comprising Nirez polyterpene resin, available from Tenneco Chemicals, Inc.; Newport, Div., may be developed in Sohio Odorless Solvent 3440, a kerosene fraction available from Standard Oil Company of Ohio. Other suitable combinations may be found among the materials listed in applications Ser. Nos. 837,780, and 837,591, as well as in Serial No. 27,890, filed Apr. 13, 1970, which is hereby entirely incorporated by reference.

FIGS. *2a–2d* illustrate in partially schematic, cross-sectional views, process steps typically used in the advantageous system of the present invention. Although the imaging members used in the illustrations of FIG. 2 are similar to the imaging member illustrated and described in conjunction with FIG. 1*a*, it should be understood that any of the migration imaging members described herein, or any other suitable migration imaging member, may be used in the advantageous system of the present invention. The basic steps of the migration imaging system, as clearly described in copending applications Ser. Nos. 837,780 and 837,591, as referenced above herein, generally comprise providing a migration imaging member, applying an imagewise migration force to the migration imaging member, and developing the member to change the resistance of the softenable layer to migration of the migration marking material thereby causing an imagewise migration of said marking material at least in depth in said softenable layer toward the substrate.

The preferred method of applying an imagewise migration force to the migration marking materials is to provide an electrical latent image on the migration imaging member. Various methods of providing electrical latent images and electrostatic latent images are described in the aforementioned copending applications. A particularly preferred method of providing electrical latent images is the optimum charge-expose mode wherein the migration imaging member comprises an electrically photosensitive material, which when substantially uniformly electrically charged and imagewise exposed with activating electromagnetic radiation forms an electrical latent image corresponding to the imagewise exposure. Upon development, the migration marking material, which is typically particulate material, migrates in imagewise configuration and in image densities proportional to the charge densities in the electrical latent image, or when the charge-expose mode is used, proportional to the amount of exposure to activating electromagnetic radiation. In this way continuous tone (or half-tone) migration images result from the migration imaging system.

The term "electrical latent image" is used to describe the latent image in the advantageous system of the present invention, and that term and the several variant forms thereof used herein include the images formed by the charge-expose mode, which images cannot readily be detected by standard electromagnetic techniques as an electrostatic latent image for example of the type found in xerography may be so that no readily detectable or at best a very small change in the electrostatic potential is found after exposure (when using preferred exposure levels); and include electrostatic latent images of a type similar to those found in xerography which are typically readily measurable by standard electrometers, that is electrostatic latent images showing surface potentials typically reading at least about 5 to 10 volts.

FIGS. *2a* and *2b* illustrate the optimum charge-expose mode of forming an electrical latent image on an imaging member. In FIG. *2a* migration imaging member, here comprising substrate 11 having conductive coating 12 thereon, supports softenable layer 13 having fracturable layer of migration marking material 14 contiguous the surface of said softenable layer opposite the substrate. This member is illustrated being electrically grounded 16, and electrically charged with an electrical charging device such as a corona charging device 15, which passes adjacent the surface of the imaging member. In FIG. *2b*, the charged imaging member is shown being imagewise exposed to activating electromagnetic radiation in areas 17. Upon exposure, the electrically photosensitive material in the present invention apparently undergoes a selective relocation of charge into, within or out of the material, said relocation being affected by the activating electromagnetic radiation acting on the bulk or surface of the electrically photosensitive material. This may specifically include photoconductive effects, photoinjection, photoemission, photochemical effects and others which enhance or cause selective relocation of charge in the electrically photosensitive material.

The imagewise exposed areas of the migration marking material 14 in FIG. *2b*, which is here electrically photosensitive material, are illustrated in a shaded fashion to schematically indicate that the light exposure in areas 17 has caused the necessary effect as described above in the exposed portions of the migration marking material.

After the imagewise migration force is applied or even during its application, here in the form of an electrical latent image on the imaging member, the latently imaged member is developed by changing the permeability of the softenable material or by otherwise reducing the resistance of the softenable material to the migration of migration marking material particles through the bulk of said softenable material. In the aforementioned copending applications developing has typically meant changing the permeability or viscosity of the softenable layer either by the application of liquid solvents which soften and wash away the softenable layer, or by any other means such as solvents, solvent vapors, heat, or combinations thereof, as well as others, which soften the softenable material in situ.

In FIG. *2c* the development step in the advantageous system of the present invention is illustrated wherein the migration imaging member 10 supporting the electrical latent image is developed by contacting the latently imaged member with a developing liquid capable of at least softening the softenable material. In the embodiment of the present invention illustrated in FIG. *2c*, the volume of the developing liquid is bounded by two menisuces 20. In this embodiment, the volume of developing liquid is minimized and the meniscus is made small, or controlled, by the small spacing between the support member 19 and the imaging member 10. As the latently imaged member passes into the volume of the liquid through the meniscus 20, the softenable material of layer 13 is softened and/or dissolved, thereby decreasing the resistance of the softenable material layer to migration of the marking material 14 in depth in the softenable layer toward the substrate 11. The unmigrated marking particles 14, and portions of the softenable layer 21, are dissolved and/or washed away in the volume of solvent development liquid, and the surface tension forces and the relative movement of the imaging member to the liquid cause these residual materials to be caught up in the liquid and removed from the imaged member as it continues to pass through and out of the meniscus-bounded volume of development liquid. Depending upon the development solvent-softenable material combination, the speed of movement of the imaging member through the meniscus of development liquid, and various other development conditions, the softenable layer may, in various embodiments, be: only softened to allow migration of the marking material in depth toward the substrate, leaving the unmigrated marking material and the softenable layer substantially intact in their initial configurations, or partially removed; or substantially completely removed leaving only the migrated marking material on the substrate.

It will be appreciated that where the material of the softenable layer is left intact upon the substrate, or is only partially removed, that the imaged member comprises a fixed migration image wherein the imagewise migrated marking material is overcoated by the remaining softenable material, and is thereby protected from external destructive forces such as scratching, abrading, smudging, etc., which would ordinarily degrade or destroy an unfixed image comprising migrated marking material on the substrate without some sort of fixative overcoating. In addition, where an even greater, degree of fixing is desired, the above-described fixed imaged member may be further overcoated more easily because the particles of migration marking material are already at least primarily fixed to the substrate.

Figure 2A:
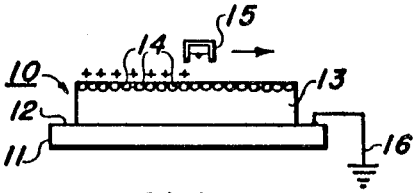
FIGS. 2*a*, 2*b*, 2*c* illustrate process steps typically used in the inventive system.
Figure 2B:
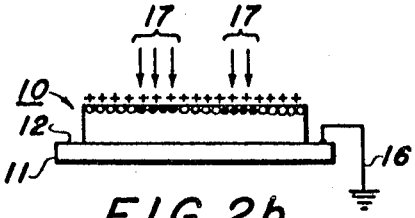
Figure 2C:
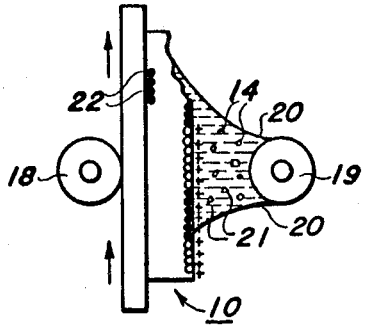
Figure 2D:
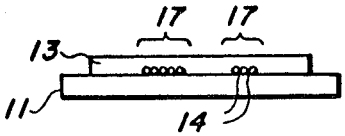
FIG. 2*d* illustrates in partially schematic, cross-sectional view an imaged member, developed and fixed in the inventive system.

FIG. 2*d* illustrates a member imaged and developed by the methods illustrated in FIGS. 2*a* through 2*c* and FIG. 2*d* clearly shows that the imaged member comprises substrate 11 having migrated marking material 14 in depth in the remaining portion of the softenable material 13 in image areas 17, and that the upper portion of the softenable layer, as well as the unmigrated marking materials are removed, as described in conjunction with FIG. 2*c*.

Although in the description in conjunction with FIGS. 2*a*–2*d* of the present migration imaging system has been primarily directed to an embodiment of that system wherein the imaging member is latently imaged by an electrical latent image, the inventive meniscus development system may be used to develop migration imaging members which have been latently imaged by any suitable means. Any of the methods of latently imaging such as member as described in the incorporated disclosures of copending applications Ser. No. 837,780 and Ser. No. 837,591 are suitable for use in systems wherein the latently imaged member may be developed by the inventive meniscus development system. For example, a migration imaging member may be latently imaged by imagewise latently changing the permeability of the softenable material, for example by imagewise hardening or imagewise softening said softenable material, and then developed in the inventive meniscus development system in the presence of a migration force such as an electrical force, magnetic force, a gravitational force, or any other force, to selectively migrate the particles in an imagewise configuration corresponding to the latent image during the advantageous meniscus development step. Indeed any means of selectively providing an imagewise migration force, i.e. latently imaging, such a migration imaging member is intended to be encompassed within the scope of the present invention.

In an alternate mode of the advantageous developing system of the present invention, the imaging member which is processed by the steps hereof may comprise an already imaged migration-type imaging member having marking material in a migrated image configuration and additionally in a background configuration, wherein the migrated image configuration is at least in part spaced apart in depth in the softenable layer from the background configuration. For example, such imaged migration-type imaging members result when the steps of forming an electrical latent image and developing by softening, for example by contacting the latently imaged member with heat, or with solvent vapors, are performed on migration imaging members such as those illustrated in FIGS. 1*a*–1*d*. However, these heat or vapor-softened developed migration type imaging members typically exhibit low contrast between the background and image area, and the advantageous system of the present invention is particularly suited for completing the development of such imaged members to enhance image quality, particularly to enhance contrast between the image and background areas. For example, when a layered configuration migration imaging member such as the one illustrated in FIG. 1*a*, is imaged by the aforementioned process steps, and then after being heat or vapor-softened developed it is processed in the advantageous liquid meniscus development system of the present invention, the unmigrated portions of the fracturable layer as well as a controlled amount of the material of the softenable layer are removed thereby providing a more fully developed, imaged migration imaging member much like the one illustrated in FIG. 2*d*.

When the liquid meniscus development system of the present invention is used on imaged migration-type imaging members as described above, the developing liquid, or developing solvent liquid, may be any suitable developing liquid, including electrically conductive developing liquids. In the mode where an electrically latently imaged migration-type imaging member is migration developed by processing in the advantageous liquid meniscus development system of the present invention, the development liquid or development solvent liquid is typically sufficiently electrically insulating, or has other desired properties, so that the electrical charges forming the electrical latent image to which the migration image is correspondingly developed, are not dissipated at least until after the migration is initiated. Although substantially electrically insulating developing liquids as stated above are typically used for this purpose, in various embodiments more electrically conductive or semi-electrically conductive liquids may be suitable for use in various embodiments of the developing system. These latter types are particularly suitable for use in embodiments where the migration force is a non-electrical force, for example a magnetic force as described in the disclosures incorporated herein.

In various embodiments of the liquid meniscus development system illustrated in FIG. 2*c*, the liquid meniscus may extend between the two supporting members 18 and 19, and the imaging member may pass anywhere between the two members even with liquid on both sides of the imaging member. The support member 18 illustrated in FIG. 2*c* in contact with the backside of the substrate of the imaging member, may variously be a bar, roller, plate, sheet, shoe or any other desired configuration in various embodiments.

Figure 3:
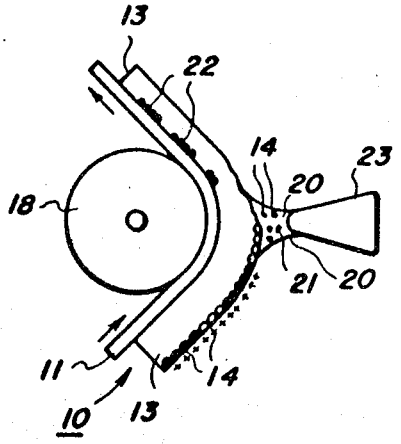
FIG. 3 illustrates in partially schematic, cross-sectional view another embodiment of the meniscus development system of the present invention.
Figure 4:
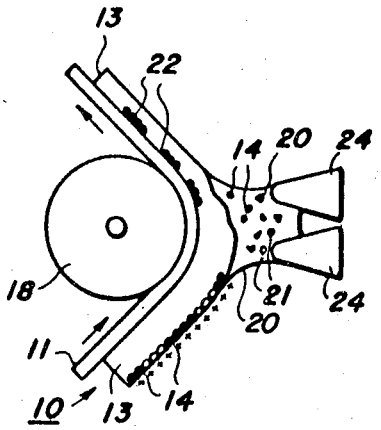
FIG. 4 illustrates in partially schematic, cross-sectional view another embodiment of the meniscus development system of the present invention.

The meniscus supporting member 19 illustrated in FIG. 2*c* as a rod or roller, may in various embodiments of the inventive system take on any desired shape. For example, in FIG. 3 and FIG. 4, the meniscus supporting members 23 and 24 are shown in a wedge-shaped cross-section, and in a pair of wedge-shaped cross-sections, which lend to the development system a flexibility in defining the size and shape of the small volume of liquid bounded between surface meniscus areas 20. Indeed, any other desired shape may be used for the meniscus supporting members, so that the volume of liquid and meniscus shape and area may be controlled and correlated with the speed of the imaging member being developed and the composition of the developing liquid to control the tension forces in the meniscus itself, which in turn help control the sweeping action of the meniscus across the surface of the imaging member. The support member should comprise material which is not rapidly attacked by the development liquids used herein, in addition the development liquid typically does not excessively wet the surface of the support member so that liquid does not leave the meniscus bounded volume or spread to other members connect to the support member.

The volume (typically a small volume) of meniscus bounded developing liquid acts upon the imaging member in the inventive system in a variety of ways. For example, the sweeping action of the liquid itself across the surface of the imaging member that is being developed which is caused by the relative movement of the member and the liquid, causes agitation of and turbulence within the liquid itself as well as the imaging materials which are removed during the development period. As the liquid is agitated, portions of the developing liquid which contain lesser concentrations of the removed imaging materials, (for example, dissolved softenable material, and residual marking materials) is continuously brought in contact with the imaging member. Of course the total volume of the meniscus bounded small volume of liquid may be varied and various volumes may similarly affect the quality of development in the inventive system. For example, the volume of liquid may control the effective cross-sectional area in which the imaging member spends resident developing time; i.e., the volume of liquid may control the amount of the surface of the imaging member which is actually wetted at any give time. The more uniform the concentration of the developing liquid and the average residence time in the developing liquid, the more uniform the density of the image developed in the inventive system. In still another way, the volume of developing liquid may affect the size of the boundry meniscus, and because the more narrow the meniscus boundry, the greater the surface tension in the area of the meniscus, the volume of the liquid may in this way affect the sweeping action already discussed above. In still another way, the very fact that the amount of developing liquid present in the inventive system may in many embodiments be a very small volume, and because the residence time of the imaging member in the vicinity of such a small volume of meniscus bounded liquid is a relatively short time, the imaging member experiences less exposure to the vapors of the development liquid, which may variously affect the quality of the finally developed migration-type imaging member. This minimal area of evaporation also reduces consumption of developing liquid.

The size of the meniscus supporting member will also help to define the shape and tension forces in the meniscus, as well as define the volume of liquid which may be placed in the meniscus-bounded development system. The small size of the meniscus, and typically the small volume of liquid bounded by the meniscus, also allows the development system to be freely oriented in almost any desired configuration, thereby facilitating bounding of the development liquid and construction of compact development apparatus. The small spacing between the meniscus supporting member and the imaging member, which controls the size of the advantageous small meniscus in the present invention, is typically not greater than about 20 mils at the closest point of spacing. Preferably, this closest spacing may be in the range of between about 3 and about 15 mils for preferred development processing wherein the support member is close enough to the surface of the imaging member to create agitation and turbulence in the development liquid near the meniscus. The spacing between the two supporting members between which an imaging member is passed in the inventive system is typically adjusted so that including the thickness of the imaging member, the imaging member-support member spacing (which controls the meniscus) is in the above ranges at its most narrow point. However, the size of the meniscus itself, which may be most conveniently defined as the length of the chord defined by the ends of the small meniscus, may typically be of chord length up to about 150 mils, when meniscuses of smaller chord lengths being preferred because of the greater surface tension forces therein, less meniscus vibration, greater pressures in the liquid volume, less amount of liquid drawn onto the imaging member, and the greater turbulence and agitation caused thereby in the advantageous system of the present invention. It is noted that wetting of the imaging member, for example as depicted in FIG. 2*c*, will typically extend the length of the meniscus (and its chord) to lengths beyond the typical supporting member-imaging member spacings already described herein.

Because in many embodiments the advantageous system of the present invention use a minimum amount of the developing liquid, it is desirable to periodically or continuously replenish the liquid in the meniscus-bound region in order to keep the concentrations of dissolved softenable material and unmigrated marking materials in the developing liquid at minimum levels so that effectiveness of the development liquid in performing its development function is not reduced. Any suitable means of adding new, and more pure development liquid into the meniscus-bounded volume may be used in the inventive system. For example, new developing liquid may be drop-wise added into the meniscus-bounded volume, and at the same time, small amounts of the used liquid may be removed therefrom by any suitable means, for example, by removing drops thereof through a pipet inserted into the volume of the developing liquid. The addition and removal of liquid from the small volume of liquid which actually performs the development step in the inventive system also serves to control the total volume of this relatively small volume of developing liquid, and as well control the wetted surface area defined by the meniscus boundaries as the liquid sweeps across the imaging member. In some embodiments, it may be advantageous to recycle the development liquid. Such a recycle system may even include filters or other reconcentration systems.

The flow rate of development liquid into and from the volume of development may also be used to control or shorten the residence time required in the development liquid by directing the flow of incoming liquid towards the surface of the imaging member being processed in the advantageous system of the present invention. The incoming stream of liquid flowing toward or onto the surface of the imaging member typically increases the dissolving action, and enhances agitation and turbulence in the development liquid which as discussed above, typically arises from the sweeping action of the liquid and its meniscus across the surface of the imaging member.

Although as discussed above the purity of the development liquid may enhance the development process, for other purposes, it may be desirable to maintain higher concentrations of material, such as fixative materials, in the small volume of meniscus bounded development liquid. A suitable fixative material may be added to the development liquid so that as or after the migration development is affected, a thin film of the fixative in solution in the development liquid is applied to the developed imaging member as it emerges from the meniscus bounded wetted area. This system is particularly suitable for use in systems where it is desirable to use a fixative which is different from the material comprising the softenable layer. Of course, such systems will typically use materials for the development liquid, the fixative, and the softenable material, as well as the other materials comprising the imaging member and system, which are mutually compatible. It will of course be appreciated that the system using the meniscus bounded liquid as described herein may be used solely as a process for fixing particulate images wherein a substrate supporting a particulate image, or any other sort of image which it may be desirable to overcoat with a suitable fixative or other coating is passed through the small volume of meniscus bounded liquid, and said liquid contains a suitable fixative in such concentrations that the fixative is precipitated onto the imaged member as the development liquid, which is here simply a carrier liquid for the fixative, evaporates from the processed member.

Embodiments of the present invention wherein the meniscus-bounded, small liquid volume development system is used, so minimizes the presence and consumption of liquid in the migration imaging system, that it may be thought of as a very nearly dry development system. Furthermore, this imaging and development system lends itself to the continuous processing of migration imaging films. For example, in FIG. 5 an embodiment of the advantageous system of the present invention is described wherein such continuous processing of latently imaged migration imaging members is facilitated. The migration imaging member is placed with its substrate in contact with a moving web or belt 28 which may be continuously driven through the development system by any suitable means, for example a drive roller, and the belt or web upon which the migration imaging member is mounted may be guided into the meniscus-bounded development area by guide and/or tension rollers or any other suitable means, such as those illustrated at 29 in FIG. 5. In a further embodiment of this system, the imaging member itself may be in the form of a strip of imaging film and may be self-supporting web which is moved through the meniscus-bounded development area.

Figure 5:
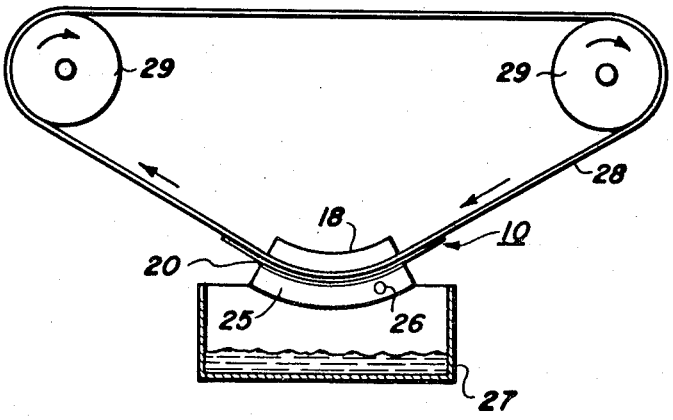
FIG. 5 illustrates in partially schematic, cross-sectional view still another embodiment of the meniscus development system of the present invention, this embodiment particularly suited to the continuous development of migration imaging films.

The meniscus-bounded development system of FIG. 5 is particularly described in conjunction with supporting members 18 and 25 which are here a pair of curved, parallel plates between which the imaging member and/or self-supporting web or belt moves and the small volume of developing liquid is contained, and between which, at the edges of the volume of developing liquid, a meniscus is formed. In the illustrated system, the web upon which the substrate of the imaging member rests typically passes directly in contact with the upper member 18, and the meniscus bounding the small volume of developing liquid is formed between the lower supporting member 25 and the imaging member 10. In this system where only the face of the imaging member is wetted, less liquid is carried out of the system and there is less drag between the belt 28 and support member 18, than in systems where both sides of the imaging member (or belt) are wetted. The system of FIG. 5 is provided with an orifice 26 into which fresh development liquid is provided to the small volume of developing liquid between the members 18 and 25, and the used volume of developing liquid is forced out of the small volume area defined by the members 18 and 25 and is allowed to overflow into overflow pan 27. Hence the volume of developing liquid is defined by the volume bounded by the plates 18 and 25 (with the imaging member between them) and the meniscus 20 at the edges of the small volume of the developing liquid. The speed at which the imaging member or film may be processed in the inventive system is dependent upon the wetted area, developing liquid, softenable material and the mechanical problems of supplying and replenishing the development liquid to the meniscus bounded liquid volume. For example, in the system of FIG. 5, 35 mm films are typically developed at speeds about 0–3 in/sec., although the system is capable of higher speed operation. The small volume of liquid in this type of system is typically in the range between about 0.05 cc/cm$^2$ and about 0.3 cc/cm$^2$ of imaging film surface. Flow rates of liquid through the system are in the range between about 0.008 cc/cm$^2$ and about 0.025 cc/cm$^2$ of imaging film surface.

Although the system described in FIG. 5 has been described as a continuously operative system, it is adaptable to semi-continuous or stepwise operation; i.e., where the imaging member is a series of photographic type image frames, a semi-continuous frame-by-frame may be used.

Figure 6:
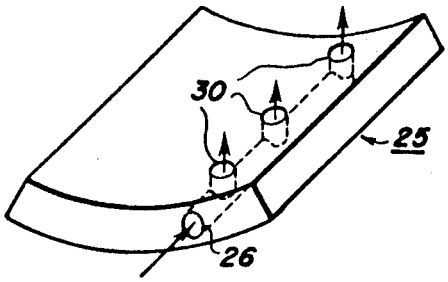
FIG. 6 illustrates in partially schematic, isometric view the lower member of the meniscus development system illustrated in FIG. 5.

FIG. 6 is an isometric view of the lower liquid supporting plate 25 from FIG. 5, and the orifice into which the fresh developing liquid is injected is clearly illustrated at 26. The outlet orifices 30 are shown in the face of this developing liquid support member, which face is typically adjacent and parallel to the imaging materials in the imaging member during the advantageous process of the present invention.

Figure 7:
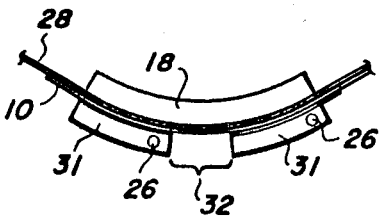
FIG. 7 illustrates in partially schematic, cross-sectional view another embodiment of the meniscus system illustrated in FIG. 5.
Figure 10:
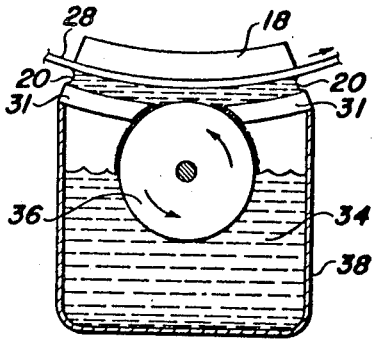
FIG. 10 illustrates in partially schematic, cross-section view another embodiment of the meniscus development system of the present invention including means for transporting development liquid to and from the meniscus bounded volume.

FIG. 7 illustrates still another embodiment of the members which bound the small volume of development liquid in the system described in conjunction with FIG. 5. In FIG. 7, a pair of members 31, which are similar in construction to the lower support member illustrated in FIG. 6, replace the lower liquid supporting member 25, and these two members are spaced apart by area 32. In this way, there is a meniscus between the support member 31 and the imaging member 10 which is being developed, and a meniscus is formed at each end of each member 31, thereby enhancing the sweeping effects of the surface tension in the meniscus boundaries of the small volume of developing liquid, as the imaging member passes through the development station. In still further embodiments similar to the one illustrated in FIG. 7, the area 32 between the spaced apart support members 31 may contain a stationary or rotating roller around which development liquid may be placed in or removed from the small volume of development liquid in the development area, or one or more drains, flutes, or louvers may be used in such area 32 in order to remove development liquid from the small volume thereof between the various liquid supporting members. For example, FIG. 10 illustrates an embodiment where the meniscus (20) bounded volume of development liquid contained between support members 31 and the belt 28 which typically supports an imaging member, has development liquid 34 transported from a bath of such liquid in container 38 on the surface of applicator roller or member 36, which brings the replenishing liquid into the meniscus bounded volume and at the same time removes used development liquid from the meniscus bounded volume on the exiting surface of the applicator roller 36. Although various specific means are illustrated herein, it is clear that any suitable means for providing developing liquid to the meniscus bounded volume and removing that liquid therefrom is suitable for use in the inventive system.

Figure 8A:
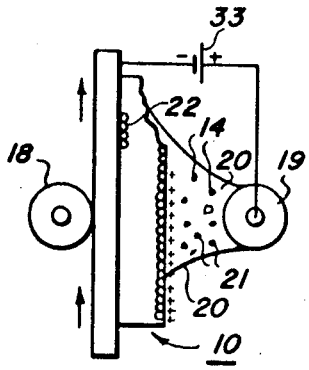
FIG. 8*a* illustrates in partially schematic, cross-sectional view an embodiment of the meniscus development system wherein the system is biased to enhance development of the migration image.
Figure 8B:
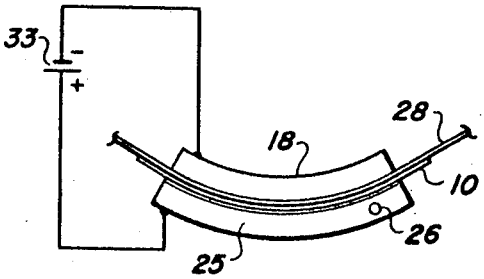
FIG. 8*b* illustrates in partially schematic, cross-sectional view another embodiment of a biased meniscus development system like that illustrated in FIG. 5.

Still further embodiments of the advantageous migration imaging and development system of the present invention are illustrated in FIG. 8*a* and FIG. 8*b*. FIG. 8*a* is similar to the meniscus bounded small volume liquid development system illustrated in FIG. 2*c* wherein the migration imaging member is shown being developed while being passed through the small volume of liquid maintained between the pair of support members. In the further embodiment illustrated in FIG. 8*a*, the liquid suport member 19 is an electrically conductive support member which serves as an electrode, and this electrode and the conductive substrate 11 of the migration imaging member are electrically connected in circuit with a source of potential difference 33 whereby the electrode member 19 and the conductive substrate 11 are oppositely biased thereby creating an electrical field across the area of the softenable layer and migration marking material. The electrical field placed across the migration imaging material and more specifically across the softenable layer and migration marking material region of the imaging member enhances the development of the image in the migration imaging member, and a system similar to the one described in copending application Ser. No. 854,596, filed Sept. 2, 1969, the entire disclosure of which is hereby incorporated by reference in the present specification.

FIG. 8*b* is another embodiment of the migration imaging and development system described in FIG. 5 wherein the liquid support members 18 and 25 are conductive electrodes, and the two members are electrically connected to opposite poles of source of potential difference 33 thereby creating an electrical field between said members which enhances development of the image in the migration imaging member in the same way in which the system of FIG. 8*a* enhances development. It should be clear that any means for providing an electrical field across the development area is suitable for use in the embodiments of the invention here described. The effect of such fields may be to electrophoreticly attract or repel particles of the migration marking material toward or from the imaging member being developed.

Figure 9:
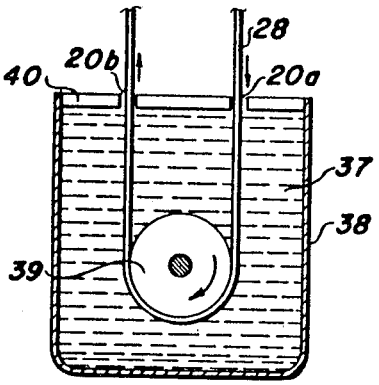
FIG. 9 illustrates in partially schematic, cross-sectional view another embodiment of the meniscus development system of the present invention.

The advantageous liquid meniscus development system of the present invention has been described above in various embodiments, many of which illustrate a meniscus or multiple meniscuses bounding at least in part a relatively small volume of the liquid developing agent. Although the presence of very small volumes of development liquid give the inventive system many advantages as pointed out above, the advantageous small meniscus development system of the present invention may be carried out in the systems wherein the total volume of developing liquid is quite large, and the system performs with many of the same characteristics which have already been described in conjunction with small volume systems. For example, in FIG. 9, a specific embodiment of the liquid meniscus development system is illustrated wherein a large volume of development liquid 37 in container 38 which has been provided with a roller or other member 39 within the volume of the development liquid in container 38, and at a top member 40 having slits or openings therein through which a web or belt 28 upon which an imaging member is supported, or a self-supporting imaging member itself may be passed into the development liquid. The top member 40 (which may be adapted so that it is always in contact with the development liquid and the container, for example by having it floating upon the surface of the volume of liquid) has the slits or openings provided therein so that spacing between the incoming imaging member and the edge of the slit or opening in the top member 40 is in the spacing range suitable for the support of the advantageous small meniscus of the present invention. As illustrated in FIG. 9, the incoming imaging member is contacted with the development liquid bounded by the small meniscus 20*a* and exits from the volume of development liquid through the meniscus boundary 20*b*. The meniscus of 20*a* and 20*b* here at least in part bound the very large volume of development liquid 37, but at the same time perform the advantageous development described herein. It is therefore seen that while small volumes of development liquid may provide further advantageous results to the inventive system, that it is the action of the small meniscus (those of very short arc and chord length) which produce the particularly advantageous results characteristic of the present invention.

Figure 11A:
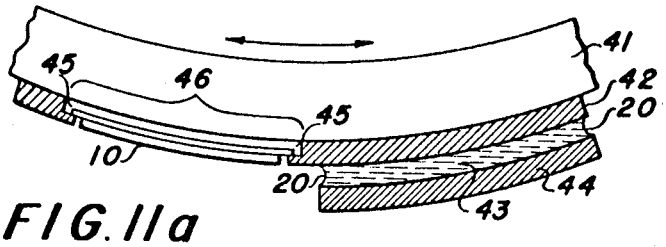
FIGS. 11*a* and 11*b* illustrate in partially schematic, cross-sectional views another embodiment of the meniscus development system of the present invention.
Figure 11B:
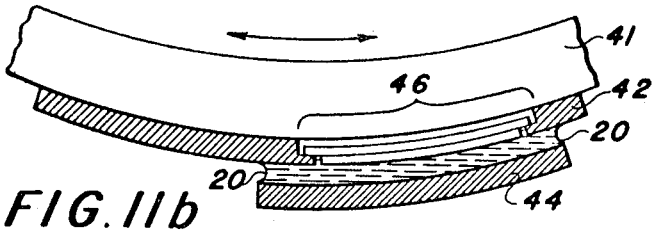

In addition to the various embodiments already describe, FIGS. 11*a* and 11*b* illustrate in partially schematic cross-sectional views a specific embodiment wherein an arcuate member 41 has on its outer arcuate surface a layer of material suitable for use in conjunction with the development liquid which is here illustrated at 43 bounded by a meniscus liquid volume which is bounded on its other surface by another support member 44 which is suitable for use in conjunction with the development liquids of the present invention. The arcuate member 41 and its surface material 42 are constructed to receive an imaging member 10 which is placed in the lipped slot 45 with the face of imaging member 10 supporting the imaging materials in position to be moved into the meniscus bounded volume of developing liquid. FIG. 11*b* shows the same apparatus depicted in FIG. 11*a* after the arcuate member has been transversely moved along an arcuate path parallel to its owns circumference (for example, by pivoting the arcuate member around the center point of its own arc through other attached means or members) moving the imaging member 10 into the volume of meniscus bounded development liquid thereby causing the advantageous effects of the present system to be achieved by the motion of the meniscus bounded development liquid across the face of the imaging member. The slotted area 46 which is adapted to receive the imaging member 10 may, in various embodiments, be provided in any size as desired in any particular application of the illustrated apparatus. For example, it may be desirable that the opening 46 be adapted to receive only a single frame of migraton imaging member or film thereby allowing such a single frame to be neatly developed when the arcuate member 41 is succesively passed into and/or out of the volume of meniscus bounded development liquid as illustrated in FIGS. 11*a* and 11*b*.

Figure 12:
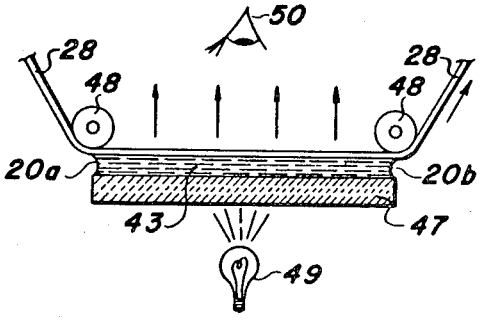
FIG. 12 illustrates in partially schematic, cross-sectional view still another embodiment of the development system of the present invention wherein development may be visually monitored as it takes place.

In still another embodiment of the advantageous system of the present invention illustrated in FIG. 12, the volume of meniscus bounded development liquid may be maintained between members, one of which, here 47, may be transparent so that light may be transmitted through the imaging member during the development process so that the development process may be visually monitored. For example, in FIG. 12, web or belt 28 supporting an imaging member, or a self-supporting imaging member is passed with its obverse side contacting roller or other support member 48 at the end of the volume of development liquid 43 bounded by meniscus 20*a* and 20*b*. Substantially transparent member 47 allows light from source 49 to be transmitted through the member 47, the development liquid 43, and the imaging member or web 28 to the eye of observer 50 who can monitor the development process as the imaging member passes through the development liquid and then exits through meniscus 20*b*. Similarly, the development liquid support members, for example as illustrated in FIGS. 3, 5, 7, 8*b*, and 11*a* and 11*b*, may be provided in substantially transparent embodiments such as the one illustrated in FIG. 12.

The following examples further specifically define the present invention wherein migration imaging members are developed in a novel development system wherein the latently imaged or partially developed migration imaging member is passed into a meniscus-bounded small volume of development liquid whereby the migration resistance of the softenable material is changed thereby allowing imagewise migration of migration marking material in depth in the softenable layer toward the substrate. The examples below are intended to illustrate various preferred embodiments of the novel migration imaging and development system.

EXAMPLE I

An imaging member is provided comprising a supporting substrate of aluminized Mylar, a polyester resin film available from DuPont with a vacuum evaporated, substantially transparent, electrically conductive layer of a aluminum vacuum evaporated thereon, and an about 2 micron thick softenable layer of Piccopale H-2, a thermoplastic hydrocarbon resin produced by the polymerization of unsaturates derived from the deep cracking of petroleum, available from the Pennsylvania Industrial Chemical Corp.; and a fracturable layer of migration marking material, here selenium, about 0.2 microns in thickness, vacuum evaporated onto the softenable layer by the process disclosed in application Ser. No. 423,167, filed Jan. 4, 1965, now abandoned, and application Ser. No. 19,521, filed Mar. 17, 1970, now U.S. Pat. No. 3,598,644. This member is then positively electrostatically charged, typically under darkroom conditions, and exposed to a negative line copy of original with white light for about 4 seconds, and then placed in vapors of 1,1,1 trichloroethane for about 10 seconds wherein selenium particles from the fracturable layer in the exposed areas of the imaging member migrate in depth in the softenable material toward the substrate.

A metal rod having a few drops of 1,1,1 trichloroethane liquid thereon is then drawn across the surface of the imaging member very closely spaced therefrom, so that a meniscus-bounded small volume of the developing liquid is drawn across the surface of the imaged member and as the meniscus-bounded, small volume of liquid sweeps across this member, a high quality, high contrast migration image is more visibly developed as portions of the softenable material layer and unmigrated selenium particles are swept up in the meniscus-bound small volume of developing liquid.

EXAMPLE II

An imaging member like the one described in Example I, except having a softenable layer comprising a custom synthesized 80/20 mole percent copolymer of styrene and hexylmethacrylate having an intrinsic viscosity of about 0.179 dl/gm (when measured in toluene), is initially imaged as described in Example I. This imaged migration imaging member is then further developed by the advantageous system of the present invention in apparatus similar to that illustrated at FIG. 2*c* and FIG. 3 in that the migration imaging member is passed between a roller nip wherein a meniscus-bounded small volume of 1,1,1 trichloroethane liquid is metered over the surface of the imaging member as the small volume of liquid is held between the surface of the imaging member and one of the rollers in the roller nip, which are spaced apart by about 12 mils. The member is passed through the nip at about 0.2 in./sec. As the imaging member passes through the small volume of meniscus-bounded developing liquid the unmigrated marking material, here selenium, and portions of the softenable layer, are swept up into the small volume of liquid and thereby removed from the imaged member to reveal a high contrast migration image which remains on the substrate and is fixed thereto by portions of the softenable material layer remaining as a coating over the imagewise migrated material.

EXAMPLE III

An imaging member and the nip roller system as used in Example II are used to develop an imaging member by the inventive process wherein in addition to passing the imaging member between the rollers which support the meniscus-bounded small volume of developing liquid, another facing sheet, here of Mylar polyester resin available from DuPont, is passed around the opposite roller, and the meniscus-bounded small volume of developing liquid is supported between the surface of this Mylar facing sheet and the surface of the imaging member, at the nip of the rolers. The imaging member and the Mylar facing sheet are passed through the roller nip at a distance of about 1/32" and the facing sheet and the imaging member move together at about the same speed. In this method some of the residual solvent, solids from the softenable material and unmigrated marking material are released to deposit on the Mylar facing sheet. This system gives results comparable to or better than the system described in Examples I and II.

EXAMPLE IV

An imaging member like the one described in Example II is uniformly electrostatically charged and exposed as described in Example I, and is then drawn past a glass rod having about a drop of solvent liquid, here 1,1,1 trichloroethane forming a meniscus-bounded small volume of the developing liquid between the glass rod and the imaging member. In this system, the latently imaged migration imaging member is simultaneously migration developed by the solvent liquid, and at the same time, portions of the softenable material layer are softened and dissolved away and the unmigrated marking materials and residual portions of the softenable layer are swept up in the small volume of meniscus-bounded developing liquid, thereby leaving the imagewise migrated marking material on the supporting substrate overcoated by the remaining portions of the layer of softenable material. In this system, the migration imaging member is simultaneously migration developed and the residual softenable material and unmigrated marking particles are removed.

EXAMPLE V

An imaging member like the one described in Example I is electrostatically charged in an imagewise pattern by passing a corona charging device over a mask in the desired image configuration, as described, for example, in application Ser. No. 483,675, filed Aug. 30, 1965. This latently imaged member is then developed by the method of Example IV, and the migration marking material, here selenium, deposits on the substrate in the charged image areas.

EXAMPLE VI

Two imaging members like the ones described in Example II are uniformly electrically charged to a surface potential of about +100 volts, exposed as described in Example I, and the first imaging member is developed by drawing it through the small volume of meniscus-bounded liquid as described in Example IV, where the gap between the meniscus supporting member and the imaging member is about 12 mils. This sample is developed as described in Example IV.

The second sample of the imaging member is developed by immersing it in a bath of 1,1,1, trichloroethane liquid in a beaker, for a few seconds, and is then removed. This imaged member comprises migrated selenium marking material on a substrate, without significant overcoating of residual softenable material.

Upon comparison of the two developed samples, it is seen that the sample developed by the small volume of meniscus-bounded liquid in the process of the present invention exhibits at least as good if not better image characteristics than the sample developed by simply immersing the latently imaged member in the bath of developing liquid. This meniscus developed image has resolution in excess of 200 lp/mm, contact density of about 2, and gamma of about 2.

EXAMPLE VII

A continuously operable development apparatus similar to that described in FIG. 5 is provided werein the moving belt 28 is an about 35 millimeter wide, about 3 mil thick strip of Mylar, a polyester resin film available from DuPont, and this belt passes around a drive roller 29 another idler roller 29, and between the members 18 and 25 which support the small volume of meniscus-bounded developing liquid. The members 18 and 25 are here curved,parallel plates of Lucite, an acrylic resin typically of an acrylic monomer, methyl methacrylate, available from DuPont. The parallel surface areas of these members are about 1 square inch, and the radius of curvature of these members is about 75 millimeters. The spacing between these members is adjustable and is set so that lower member 25 is about 1 mm from the face of the imaging member passing between the support members. The lower member is equipped with a hole drilled normal to the side of the lower member passing through most of the lower plate and the hole exits at a few orifices in the internal surface of the liquid support member. These orifics serve to supply the developing liquid to the gap between the liquid supporting members, and the liquid is metered into the external hole through a syringe which is used to controllably inject development liquid into the system. The liquid is metered into the liquid gap between the liquid supporting members near the meniscus illustrated at the right hand side of the liquid gap. An overflow pan below the liquid receives residual, used developing liquid which flows out of the sides of the gap as the replenishing liquid is forced into the gap.

An imaging member like the one described in Example IV is latently imaged and then taped onto the Mylar belt and passes under the upper liquid supporting member and is thereby advanced into the liquid gap. 1,1,1 trichloroethane liquid is metered into the development system, and the film is advanced through the meniscus bounded small volume of liquid at a speed of about 0.33 inches per second, and thereby developed as described in Example IV, with comparable results.

EXAMPLE VIII

A vapor developed imaged migration imaging member as provided in Example 1, is taped to the belt of the apparatus described in Example VII, and is passed therethrough, thereby removing residual portions of the softenable layer and unmigrated marking materials.

Gamma as referred to in the above examples, is a sensitometric quantity derived from the characteristic density vs. log exposure curve of a photographic material. It is a measure of contrast reproduced in an image formed by such material.

Although specific components and proportions have been stated in the above description of the preferred embodiments of the novel migration imaging system wherein a small volume of meniscus-bounded development liquid is used to develop migration imaging members, other suitable materials and variations in the various steps in the system as listed herein, may be used with satisfactory results and various degress of quality. In addition, other materials and steps may be added to those used herein and variations may be made in the process to synergize, enhance or otherwise modify the properties of or increase the uses for the invention.

It will be understood that various other changes of the details, materials, steps, arrangements of parts and uses which have been herein described and illustrated in order to explain the nature of the invention will occur to and may be made by those shilled in the art upon reading of this disclosure, and such changes are intended to be included within the principle and scope of this inventon.

What is claimed is:

1. In a method for developing an electrical latent image on a migration imaging member, said member comprising a substrate, a layer of softenable material on said substrate and migration material in or in contact with said softenable material, wherein the surface of said member opposite said substrate bears said latent image which is brought into and out of contact with a volume of liquid capable of developing said image by softening said softenable material sufficiently to cause migration of said migration material in depth in said softenable layer, the improvement comprising positioning a liquid support member adjacent said surface and in contact with said liquid volume which extends between said adjacent support member and said surface whereby a meniscus is formed on each liquid surface continuously between said surface and support, moving said imaging member past said support member and causing said liquid to flow in a direction away from the direction of said imaging member to provide turbulent flow of said liquid adjacent said surface whereby unmigrated migration material is removed from said imaging member and carried away in said flow.

2. The method of claim 1 wherein said softenable layer is of a thickness in the range between about ½ and about 16 microns.

3. The method of claim 2 wherein said softenable layer is of a thickness in the range between about 1 and about 4 microns.

4. The method of claim 1 wherein said migration marking material comprises particulate material of average particle size not greater than about 2 microns.

5. The method of claim 1 wherein said migration marking material is particulate material dispersed throughout the softenable layer.

6. The method of claim 5 wherein the imaging member additionally comprises a second softenable layer, said second softenable layer being initially free of migration marking mateial, and said second softenable layer contacting the substrate between the substrate and the first softenable layer

7. The method of claim 1 wherein said migration marking material is arranged in a fracturable layer contiguous the surface of said softenable layer spaced apart from said substrate.

8. The method of claim 7 wherein the imaging member additionally comprises a second softenable layer, said second softenable layer being initially substantially free of migration marking material, and said second softenable layer contacting the substrate between the substrate and the first softenable layer.

9. The method of claim 8 wherein the step of passing the surface of said imaging member through said developing liquid removes substantially all of said first softenable layer.

10. The method of claim 1 wherein the supporting substrate is electrically conductive.

11. The method of claim 1 wherein at least some point of said support member is spaced apart from the surface of the imaging member by a distance not greater than about 20 mils.

12. The method of claim 1 wherein at least some point of said support member is spaced apart from the surface of the imaging member by a distance in the range between about 3 and about 15 mils.

13. The method of claim 1 wherein the support member spaced apart from the surface of the imaging member comprises a straight edge parallel to the plane of the surface of the imaging member.

14. The method of claim 1 wherein the support member spaced apart from the surface of the imaging member comprises a support surface, said surface being everywhere substantially equidistantly spaced apart from the substrate of the imaging member.

15. The method of claim 1 wherein there are a plurality of support members spaced apart from the surface of the imaging member and small meniscuses extending between a plurality of support members and the surface of the imaging member.

16. The method of claim 1 wherein the deveoping liquid is periodicaly replenished.

17. The method of claim 16 wherein said developing liquid is continuously replenished.

18. The method of claim 1 wherein said developing liquid is at least in part periodically removed from the volume thereof.

19. The method of claim 18 wherein said developing liquid is at least in part continuously removed from the volume of developing liquid.

20. The method of claim 1 wherein the volume of developing liquid is a small volume not greater than about 0.3 $cc/cm^2$ of imaging member surface.

21. The method of claim 1 additionally comprising a uniform electrical field across said migration imaging member in the area of contact of said imaging member and the developing liquid.

22. The method of claim 1 wherein the passing of the surface of said imaging member through the developing liquid removes at least part of said softenable layer.

23. In a method for developing an electrical latent image on a migration imaging member, said member comprising a substrate, a layer of softenable material on said substrate and migration material in or in contact with said softenable material, wherein the surface of said member opposite said substrate bears said latent image and is brought into and out of contact with a volume of liquid capable of developing said image by softening said softenable material sufficiently to cause migration of said migration material in depth in said softenable layer, the improvement comprising moving said member past an adjacent liquid support member, said liquid support member being in contact with said liquid and forming a meniscus continuously between said surface and said support at least at the point of exit of said imaging member from said liquid and causing said liquid to flow in a direction away from the direction of said imaging member whereby (1) the surface tension forces of said liquid bridging said surface and said support member and (2) the relative movement of said imaging member to the liquid, cause removal of at least a portion of said development liquid which contains the unmigrated migration material from the imaging member as it passes said support member as said member is brought out of contact with said volume of liquid.

24. The method of claim 23 wherein said softenable layer is of a thickness in the range between about ½ and about 16 microns.

25. The method of claim 24 wherein said softenable layer is of a thickness in the range between about 1 and 4 microns.

26. The method of claim 23 wherein said migration marking material comprises particulate material of average particle size not greater than about 2 microns.

27. The method of claim 23 wherein the migration marking material in the complementary background pattern is particulate material dispersed throughout the background portion of the softenable layer.

28. The method of claim 27 wherein the imaging member additionally comprises a second softenable layer, said second softenable layer contacting the substrate between the substrate and the first softenable layer.

29. The method of claim 23 wherein said migration marking material in the background pattern areas is arranged in a fracturable layer contiguous the surface of the softenable layer spaced apart from the substrate.

30. The method of claim 29 wherein the imaging member additionally comprises a second softenable layer contacting the substrate between the substrate and the first softenable layer.

31. The method of claim 23 wherein the supporting substrate is electrically conductive.

32. The method of claim 31 wherein said support member is spaced apart from the surface of the imaging member by a distance in the range between about 3 and about 15 mils.

33. The method of claim 23 wherein the support member spaced apart from the surface of the imaging member comprises a straight edge parallel to the plane of the surface of the imaging member.

34. The method of claim 23 wherein the support member spaced apart from the surface of the imaging member comprises a support surface, said surface being everywhere substantially equidistantly spaced apart from the substrate of the imaging member.

35. The method of claim 23 wherein there are a plurality of support members spaced apart from the surface of the imaging member and small meniscuses extending between each of the plurality of said support members and the surface.

36. The method of claim 23 wherein the developing liquid is replenished.

37. The method of claim 35 wherein said developing liquid is continuously replenished.

38. The method of claim 23 wherein said developing liquid is at least in part periodically removed from the volume of developing liquid.

39. The method of claim 37 wherein said developing liquid is at least in part continuously removed from the volume of developing liquid.

40. The method of claim 23 wherein the volume of developing liquid is a small volume not greater than about 0.3 $cc/cm^2$ of imaging member surface.

* * * * *